United States Patent [19]

Stomski et al.

[11] Patent Number: 4,742,973

[45] Date of Patent: May 10, 1988

[54] WIRE FEED CONTROL

[75] Inventors: Lawrence Stomski, Sterling Heights; John Zacharek, Detroit, both of Mich.

[73] Assignee: Michael Ladney, Grosse Pointe Shores, Mich.

[21] Appl. No.: 52,718

[22] Filed: May 21, 1987

[51] Int. Cl.[4] ..... B65H 59/04

[52] U.S. Cl. ..... 242/156

[58] Field of Search ..... 242/156, 156.2, 129.8, 242/75.43

[56] References Cited

U.S. PATENT DOCUMENTS

| | | | |
|---|---|---|---|
| 1,809,940 | 6/1931 | Kronmiller | 242/156.2 |
| 2,254,255 | 9/1941 | Zeruneith | 242/156.2 |
| 2,417,818 | 3/1947 | Finn | 242/156 X |
| 2,673,044 | 3/1954 | Sellon | 242/156 X |
| 2,766,945 | 10/1956 | Reich | 242/156.2 X |
| 2,983,468 | 5/1961 | Perrella | 242/156.2 |
| 3,069,107 | 12/1962 | Hirt | 242/156 X |
| 3,223,352 | 12/1965 | Fuller et al. | 242/156.2 |
| 3,353,762 | 11/1967 | Baselice . | |
| 3,877,657 | 4/1975 | Zebley . | |
| 4,269,369 | 5/1981 | Stroup . | |
| 4,322,039 | 3/1982 | Stevens . | |
| 4,422,583 | 12/1983 | Maxner et al. . | |

FOREIGN PATENT DOCUMENTS

| | | | |
|---|---|---|---|
| 1024913 | 2/1958 | Fed. Rep. of Germany | 242/156 |
| 2055700 | 5/1972 | Fed. Rep. of Germany | 242/156 |

*Primary Examiner*—Stanley N. Gilreath

*Attorney, Agent, or Firm*—Brooks & Kushman

[57] ABSTRACT

A wire play out control apparatus for an intermittent wire strand feeder comprises an elongated, deflectable member including a strand guide for controlling displacement of a strand along the length of the deflectable member. The deflectable member is mounted at one end of a lever pivotally secured intermediate its ends so that the opposite end of the lever is aligned for pivotal displacement between a first position engaging a brake against the spool and a second position disengaging the brake from the spool. The outlet of the strand guide is positioned in axial alignment with the feed axis of the feeder. The pivot mounting also permits lateral adjustment of the strand guide inlet with the play out position of the strand on the spool. The second position of the lever is defined by a stop member to limit displacement between said first and second positions, thereby avoiding excess movement which inhibits quick play out from the spool, and shortening the strand guide length by enhancing deflection of the elongated, deflectable member which provides greater change in the guide path length for enhanced storage of the strand between feeder actuations.

17 Claims, 1 Drawing Sheet

WIRE FEED CONTROL

BACKGROUND OF THE INVENTION

I. Field of the Present Invention

The present invention relates generally to apparatus for automatically uncoiling a spool of wire, and more particularly to apparatus for controlling the delivery of the strand from the spool in response to the intermittent operation of the feeder.

II. Description of the Prior Art

Strands of wire are often fed into fabricating machines which bend or stamp the wire into a predetermined shape. During a stamping operation, displacement of the wire strand being fed into the machine is temporarily but repeatedly stopped so that the stamping operation occurs at a predetermined position on the workpiece being formed. Quite often, discrete workpieces are stamped and punched from a supply of wire strand in the form of a coiled spool of wire so that a large supply of the wire strand can be continuously fed into the machining apparatus. While the feeding of wire is normally controlled by a feeder which operates in conjunction with the machining apparatus, for example, pinch rollers aligned to pull the strand into the machine, the inertia of the spool can substantially affect the feeding or displacement of the strand into the machining apparatus. For example, the inertia of the spool may resist the feeding of the strand through the pinch rollers and thus cause slippage between the rollers and the strand which affects the length of the strand being fed into the machining apparatus. Moreover, once the spool has started rotating, intermittent stoppage of the pinch rollers does not immediately affect the momentum of the rotating spool and thus may cause uncontrolled play out of the wire between the deactivated pinch rollers and the coil. Such uncontrolled play out can cause kinking and other uncontrolled deformation of the wire played out between the coil and the feeder.

Some previously known devics for controlling rotation of the coil attempt to actuate and deactuate rotation of the spool by driving the spool in response to play out or actuation and deactuation of the pinch rollers. For example, U.S. Pat. No. 4,269,369 to Stroup and U.S. Pat. No. 4,422,583 to Maxner et al disclose switching apparatus for controlling a powered drive mechanism for the coil. However, such switching devices are complex and require a substantial amount of power to control the heavy spools of wire. Thus, such devices are relatively expensive and require maintenance of a substantial number of components.

SUMMARY OF THE PRESENT INVENTION

The present invention overcomes the above mentioned disadvantages by providing a passive system for controlling the delivery of a wire strand to a feeder from a spooled coil. In general, an elongated member including a strand guide is displaceable from a predetermined position by deflection of the member, movement of a support for the member, or both, whereby a mechanical actuator releases a brake that normally engages the spool. Displacement of the elongated member from its predetermined position is resisted by means for biasing the strand guide outlet to its predetermined position. Such biasing can be by a resiliently biasing means such as a tensioning spring or the resiliency of a spring leaf forming the elongated member.

In the preferred embodiment, the elongated member is a spring leaf mounted at one end of a lever. The lever is pivotally supported intermediate its ends so that a brake positioned at its other end is aligned for engagement with the spool, and the lever is resiliently biased by a tensioning spring so that the brake normally engages the spool.

Upon actuation of the feeder, the elongated member is displaced toward the feeder and thus minimizes resistance to displacement of the strand through the feeder. The inertia of the reel is, therefore, subsequently and gradually applied as resistance to the feeding force of the feeder. Conversely, when the feeder is deactivated, the elongated member returns to its normal shape and position to increase the controlled path length between the coil and the feeder during continued rotation of the coil and play out of the strand due to momentum. Moreover, the resiliently biased lever returns to the position at which the brake engages the spool.

Thus, the present invention does not require an additional power source for continued energy input to rotatably drive and brake the spool of coiled wire. Moreover, the control of the present invention maintains accurate alignment of the wire strand as it is played out from the spool and prepositions it for accurate alignment with the feeder.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which.

DETAILED DESCRIPTION OF A PREFERRED EMBODIMENT

Figure 1:
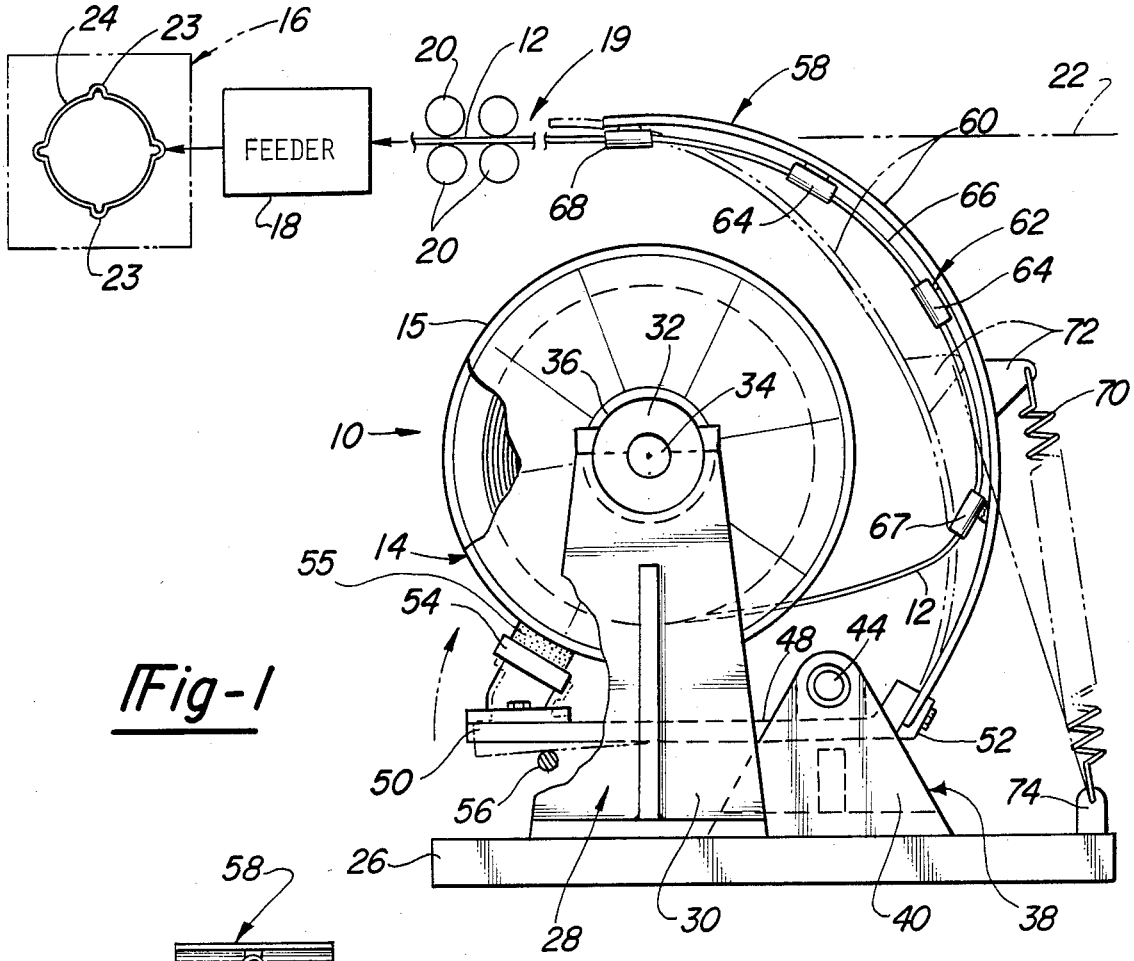
FIG. 1 is a side view of the play out control apparatus constructed according to the present invention.
Figure 2:
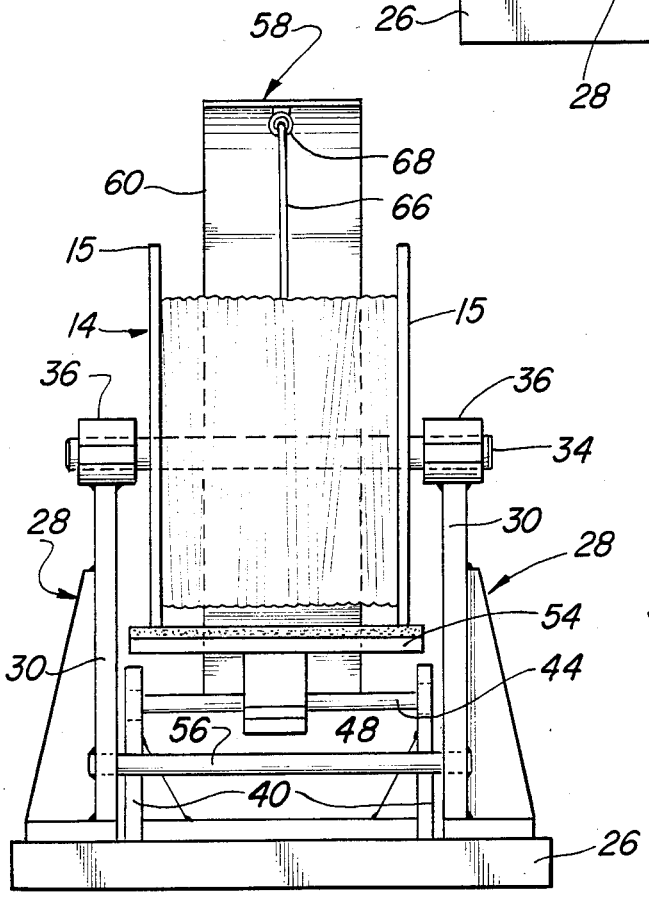
FIG. 2 is an end view of the play out control apparatus shown in FIG. 1.

Referring first to FIG. 1, a wire play out control apparatus 10 according to the present invention is thereshown for delivering a strand 12 supplied in a coil upon a spool 14 to a machine apparatus 16 including a feeder 18. The feeder 18 includes an inlet 19 which is diagrammatically represented by a plurality of aligned straightening rollers 20 engaging the strand 12 along a predetermined feed axis 22, although it is to be understood that the particular form of feeder 18 and machine apparatus 16 is variable without departing from the scope of the present invention. The wire play out control apparatus 10 permits the feeder 18 to control the predetermined amount of strand 12 which must be intermittently fed into the machine apparatus 16 to produce a workpiece with accurately positioned workpiece features and workpiece sizes. For example, the workpiece 24 shown in FIG. 1 comprises a ring having lobes 23 formed at predetermined circumferential positions.

In the preferred embodiment, the control apparatus 10 comprises a base or support 26 including a stanchion 28 adapted to rotatably support the spool 14. The stanchion 28 includes a pair of spaced arms 30 which include registering bearings 32 which rotatably support an axle 34 adapted to be engaged within the center of the spool 14. The bearing 32 may be detachably secured to the stanchion 28 by removable bearing blocks 36 as shown in FIG. 1. A second stanchion 38 comprises a pair of arms 40 which rotatably support a pivot pin 44 which serves as a fulcrum for a lever 48.

The lever 48 is mounted to the pivot pin 44 at a position intermediate a first end 50 and a second end 52. The lever 48 may be slidably mounted on the pivot pin 44 for a reason to be discussed in greater detail hereinafter. The first end 50 of the lever 48 includes a braking bar 54 aligned for engagement with the periphery of the spool ends 15 and pivotable between a first position at which the breaking bar 54 engages the periphery of spool ends 15 and a second position spaced apart from the periphery of the spool ends 15. The braking bar 54 may include a braking pad 55 of rubber or the like which increases frictional engagement. Furthermore, the braking means may be of other known types, for example, a caliper brake mechanism which is actuated by displacement of the lever end 50. In the preferred embodiment, the second position of the lever 48 is defined by a stop bar 56 extending across the arms 30 of the stanchion 28.

The other end 52 of the lever 48 supports a deflectable, elongated member 58 which in the preferred embodiment, is formed from a spring leaf 60. The spring member 58 includes a strand guide 62 made up of a plurality of annular eyelets 64 spaced along the length of the spring member 58. The annular eyelets 64 define a strand guide path 66 whose length varies depending upon the position of the eyelets 64 as the spring member 58 is displaced as will be described in greater detail hereinafter.

The leaf spring 60 is normally resiliently biased in a curved or arcuate disposition, and the outlet 68 of the strand guide is substantially aligned with the feed axis 22. The inlet 67 of the strand guide 62 is near the end of the spring leaf 60 which is secured to the end 52 of lever 48, and is substantially aligned with the wire strand's play out position. Moreover, in the preferred embodiment, the peripheral edge of spool ends 15 and the stop member 56 limit displacement of the lever 48, and thus movement of the spring member 58, so as to maintain the inlet 67 and outlet 78 in their substantially aligned positions.

The elongated spring member 58 also includes a support flange 72 connecting one end of a tensioning spring 70 while the other end of the spring 70 is secured to a support flange 74 on the support 26 so as to bias the elongated member 58, and thus the end 52 of the lever 48, to a position at which the lever end 50 is normally urged into its first position. Such positioning of the lever 48 causes engagement of the braking bar 54 against the periphery of the spool ends 15.

Having thus described the important structural features of the present invention, the operation of the device can be readily described. A spooled coil of wire can be slid onto an axle 34 and bearings 32 contained within the bearing blocks 36 are installed over the ends of the axles. The bearing blocks 36 are bolted to the stanchion arms 30 when the spool is lifted into position on the stanchion 28. Although the axis of rotation for the spool 14 is preferably horizontal and perpendicular to the feed axis 22, it will be understood that modifications of the positioning of the spool, such as supporting the spool on a table rotatable about a vertical axis would also be within the scope of the present invention.

In view of the fact that the position of the strand as it is played out from the spool changes along the axial length of the spool, the slidable mounting of the lever 48 on the pivot pin 44 permits the spring member 58, and thus the strand guide path 66 to adjust parallel to the spool axis for alignment of the inlet with the strand position.

In any event, a strand 12 being played out from the spool 14 is fed into the inlet 67 of the strand guide 62 so as to extend along the path 66 of the strand guide 62 to and through the outlet 68 of the strand guide. Moreover, the outlet 68 of the strand guide is aligned with the feeder inlet 19 on feed axis 22 so as to preposition the strand 12 for proper alignment and engagement within the feeder 18. Even when the lever 48 is slidably supported for lateral adjustment along pivot pin 44, the resiliency of the spring member 58 enables the outlet 68 to remain substantially aligned with the feed axis 22. In any event, the outlet 68 of the strand guide 62 is spaced apart from the feeder 18 at a predetermined position so that displacement of the spring member including deflection of the spring member 58 does not interfere with the pinch rollers 20.

As the strand 12 is drawn into the machine apparatus 16 by the feeder 18, the displacement of the strand 12 into the machine apparatus 16 is resisted along the path 66 of the strand guide 62 primarily due to the inertial effect of the spool 14. Thus, as the feeder 18 begins to displace the strand 12, the strand 12 pulls against the strand guide 62 and displaces the spring member 58 and the strand outlet 68. Such displacement includes deflection of the spring member 58 toward the position shown in phantom line in FIG. 1. In addition, the force applied to the spring member 58 urges the spring member to a position at which the lever 48 pivots about the pivot pin 44 against the tensioning force of spring 70 unit the end 50 of lever 48 engages the stop member 56. Thus, the stop member 56 is positioned to limit the displacement of the lever 48 once the brake has been released. This limitation prevents the strand tensioning force from causing excess movement of the lever which would delay application of the tensioning force at the spool. Consequently, the play out of the strand from the spool is initiated sooner. The stop member 56 also assures that continued pulling of the strand against the strand guide causes deflection of the spring member 58 and shortens the path 66 between the feeder 18 and the spool 14. This shortening of the path enhances the change in guide path length so as to increase storage capacity of the strand guide between actuations of the intermittent feeder.

Thereafter, the momentum of the strand 12 in conjunction with the force applied to the strand by the feeder 18 gradually applies sufficient force to initiate uncoiling of the strand 12 from the spool 14 so that additional strand can play out from the spool. Nevertheless, the outlet 68 of the strand guide 62 remains substantially aligned with the inlet 19 on feed axis 22.

As the strand 12 is stopped by the feeder 18, the pulling force supplied to the strand guide 62 is terminated. Moreover, due to the momentum of the spool 14, it will be appreciated that an additional length of strand 12 is played out from the coil and delivered to the strand guide inlet 67. The additional strand length introduced into the strand guide 62 releases the tension which deflected the spring member 58 to its deflected position and enables the spring member 58 to return toward its original predetermined position. In doing so, it will be appreciated that the strand guide path 66 lengthens due to the substantially larger arc formed by the spring member 58 in its undeflected position. As a result, the enlargement of strand guide path 66 accommodates the additional play out from the spool due to momentum.

Moreover, as the spring member 58 returns to its original position and the force of the spring 70 urges the second end 52 of the lever 48 downwardly, the first end 50 of the lever 48 is raised. Consequently, in the preferred embodiment, actuation of the brake in response to the return of the spring leaf 60 is accomplished by lifting the braking bar 54 into engagement with the periphery of the spool ends 15. As a result, the braking means terminates rotation of the spool 14. When the feeder 18 is again activated, the process previously described is repeated.

Attachment of the spring 70 to an intermediate portion of the spring member 58, as in the preferred embodiment, rather than directly at the end 52 of lever 48 provides greater leverage for actuation of the lever so as to permit faster actuation of the brake. Furthermore, it contributes to more responsive action of the spring member 58.

It may be appreciated that the release of the brake by displacement of the unsupported end of the spring member 58 occurs as a combination of forces in the preferred embodiment. First, the spring member 58 itself deflects so as to change the balance in the lever 48 and thus permit release of the brake when feeding of the strand has been initiated. In addition, the spring member 58 is moved by pivoting of lever 48.

It is contemplated that either biasing means could be solely relied upon to control displacement of the outlet 68 of the strand guide. Thus, it is conceivable that the tensioning spring 70 could be eliminated if the lever 48 were balanced or counterbalanced to normally return to its brake engaging position. Alternatively, the resilient biasing of the spring member 58 itself might be reduced, whereby initial pulling of the strand against the strand guide merely displaces the unsupported end of the spring member against the force of the tensioning spring 70.

In the alternative modification, where the elongated member 58 has little or no resiliency, a substantially greater degree of movement for the lever 48 would be necessary in order to provide the same reduction in the strand guide path which would be possible if the spring member were also deflectable. Thus, the combination of spring member deflection, and spring member displacement utilized in the preferred embodiment maximizes the efficiency of the control and reduces the area in which the control apparatus operates.

Thus, the present invention provides control for the play out of a coiled wire being intermittently fed into a machine apparatus. Moreover, the control apparatus does not require additional energy input apart from the energy used to drive the feed mechanism. Nevertheless, the control effectively accommodates the inertia of the spool by initiating displacement of the strand into the feeder. In addition, the apparatus accommodates play out of the strand due to the momemtum of a moving spool when the feeder has momentarily stopped by increasing the path length of the strand guide which receives the played out strand. Furthermore, it will be appreciated that enlargement of the strand guide path coincides with actuation of a brake to counteract the momentum built up in the spool. Thus, the control apparatus of the present invention prevents slippage of the strand within the feeder and uncontrolled play out of the strand during an intermittent feeding operation.

Having thus described the present invention, many modifications thereto will become apparent to those skilled in the art to which it pertains without departing from the scope and spirit of the present invention as defined in the appended claims.

What is claimed is:

1. A wire play out control apparatus for delivering a coiled wire strand from a spool having an axis to an intermittent wire strand feeder comprising:

a support;

means for rotatably mounting the spool on the support;

an elongated member including an elongated strand guide for guiding the wire strand along the length of said member, said strand guide having an inlet and an outlet;

means for biasing said strand guide outlet to a predetermined position;

braking means for engaging and disengaging said spool in response to displacement of said strand guide outlet to and from said predetermined position; and means for mounting said strand guide for movement of the strand guide inlet parallel to the spool axis, whereby the strand guide inlet adjusts for alignment with the spool play out position.

2. The invention as defined in claim 1 wherein said braking means comprises:

a brake member; and a brake actuator having a brake lever with a first end and a second end, a fulcrum for pivotally supporting said brake lever intermediate its first and second ends, said first end of said lever including means for engaging and disengaging said brake member against said spool, and said second end supporting one end of said elongated member adjacent said strand guide inlet, whereby displacement of the other unsupported end of said elongated member adjacent said outlet pivots said lever to and between a first position at which said brake member engages said spool and a second position at which said brake member is disengaged from said spool.

3. The invention as defined in claim 2 wherein said biasing means comprises means for urging said brake lever to said first position.

4. The invention as defined in claim 3 wherein said means for urging comprises means for resiliently biasing said brake lever to said first position.

5. The invention as defined in claim 1 wherein said biasing means comprises said elongated member being made of a resiliently deflectable material.

6. The invention as defined in claim 5 wherein said elongated member is a spring leaf.

7. The invention as defined in claim 1 wherein said elongated member is normally arcuately curved between said inlet and said outlet of said strand guide, and wherein said strand guide outlet is positioned in alignment with said wire strand feeder.

8. The invention as defined in claim 4 wherein said means for resiliently biasing comprises a tensioning spring secured at one end to said elongated member and secured at its other end to said support.

9. The invention as defined in claim 1 wherein said means for rotatably supporting said spool comprises a stanchion mounted to said support and bearing means mounted in said stanchion for freely rotating said spool.

10. In combination with an intermittent wire strand feeder, and a supply of wire in the form of a coiled spool of wire having an axis, the improvement comprising:

means for controlling displacement of said wire strand between said feeder and said coil, wherein said means includes:

a resiliently deflectable, elongated control member including an elongated strand guide for guiding the wire strand along the length of said control member, said strand guide having an inlet and an outlet defining a path intermediate the spool and the feeder;

braking means for restraining rotation of said spool and releasing said spool in response to displacement of said strand guide outlet with said deflectable control member; and means for mounting said strand guide for movement of the strand guide inlet parallel to the spool axis, whereby the strand guide inlet adjusts for alignment with the spool play out position.

11. The invention as defined in claim 10 wherein said braking means further comprises:

a braking member;

a brake lever having a first end including means for displacing said braking member into engagement with said spool, a second end, and means for pivotally securing said brake lever intermediate its ends so that said first end is pivotable to and between of first position at which said braking member is in engagement with said spool and a second position at which said braking member is disengaged from said spool;

means for urging said brake lever to said first position; and means for supporting said deflectable member at said second end of said brake lever;

wherein said means for mounting comprises means for slidably mounting said brake lever on said fulcrum.

12. The invention as defined in claim 1 wherein said means for mounting comprises said strand guide extending along a substantial portion of the length of said member, and wherein said outlet is longitudinally spaced from said inlet a distance substantially corresponding to said substantial portion of length.

13. The invention as defined in claim 1 wherein said braking means comprises a braking member and a brake actuator;

wherein said brake actuator comprises a brake lever with a first end and a second end;

a fulcrum for pivotally supporting said brake lever intermediate its first and second ends;

wherein said second end supports one end of said elongated member adjacent the strand guide inlet; and wherein said means for mounting the strand guide comprises means for slidably mounting said brake lever on said fulcrum.

14. The invention as defined in claim 12 wherein said braking means comprises a braking member and brake actuator;

wherein said brake actuator comprises a brake lever with a first end and a second end;

a fulcrum for pivotally supporting said brake lever intermediate its first and second ends;

wherein said second end supports one end of said elongated member adjacent the strand guide inlet; and wherein said means for mounting the strand guide comprises means for slidably mounting said brake lever on said fulcrum.

15. A wire play out control apparatus for delivering a coiled wire strand from a spool to an intermittent wire strand feeder comprising:

a support;

means for rotatably mounting the spool on the support;

an elongated member including a strand guide for guiding the wire strand along the length of said member, said strand guide having an inlet and an outlet;

means for biasing said strand guide outlet to a predetermined position;

braking means for engaging and disengaging said spool in response to displacement of said strand guide outlet to and from said predetermined position;

wherein said braking means comprises a braking member and a brake actuator; wherein said brake actuator comprises a brake lever with a first end and a second end; a fulcrum for pivotally supporting said brake lever intermediate its first and second ends; said first end of said lever including means for engaging and disengaging said braking member against said spool; and said second end supporting one end of said elongated member adjacent said strand guide inlet, whereby displacement of the other unsupported end of said elongated member adjacent said outlet pivots said lever to and between a first position at which said braking member engages said spool and a second position at which said braking member is disengaged from said spool; and a stop member for limiting displacement of said lever from said first position to said second position, whereby the limited movement avoids excess movement of the lever to initiate quicker application of the tension force at the spool for removal of the strand from the spool.

16. The invention as defined in claim 15 wherein said elongated member comprises a resiliently deflectably member, whereby the limited displacement of said lever enhances deflection of said elongated member to further shorten the guide path length and thereby provide greater change in path length which results in increased storage capacity of the strand guide between actuations of the intermittent feeder.

17. The invention as defined in claim 16 wherein said elongated member is a spring leaf.

* * * * *

UNITED STATES PATENT AND TRADEMARK OFFICE

CERTIFICATE OF CORRECTION

PATENT NO. : 4,742,973

DATED : May 10, 1988

INVENTOR(S) : LAWRENCH STOMSKI, et al.

It is certified that error appears in the above-identified patent and that said Letters Patent is hereby corrected as shown below:

In The Specification:

Column 3, line 40 "78" should be --68--.

Column 4, line 31 "unit" should be --until--.

In The Claims:

Column 8, line 53, Claim 16 "deflectably" should be --deflectable--.

Signed and Sealed this

Tenth Day of January, 1989

*Attest:*

*Attesting Officer*

DONALD J. QUIGG

*Commissioner of Patents and Trademarks*